US007441605B2

(12) United States Patent
Coronado et al.

(10) Patent No.: US 7,441,605 B2
(45) Date of Patent: Oct. 28, 2008

(54) OPTICAL SENSOR USE IN ALTERNATE PATH GRAVEL PACKING WITH INTEGRAL ZONAL ISOLATION

(75) Inventors: Martin P. Coronado, Cypress, TX (US); Elmer R. Peterson, Porter, TX (US)

(73) Assignee: Baker Hughes Incorporated, Houston, TX (US)

( * ) Notice: Subject to any disclaimer, the term of this patent is extended or adjusted under 35 U.S.C. 154(b) by 344 days.

(21) Appl. No.: 11/273,191

(22) Filed: Nov. 14, 2005

(65) Prior Publication Data

US 2007/0012453 A1 Jan. 18, 2007

Related U.S. Application Data

(63) Continuation-in-part of application No. 11/180,150, filed on Jul. 13, 2005, now abandoned.

(51) Int. Cl.
*E21B 43/14* (2006.01)
*E21B 33/12* (2006.01)

(52) U.S. Cl. ..... 166/313; 166/65.1; 166/120; 166/191

(58) Field of Classification Search ..... 166/313, 166/65.1, 179, 120, 191
See application file for complete search history.

(56) References Cited

U.S. PATENT DOCUMENTS

| | | | | |
|---|---|---|---|---|
| 2,390,372 | A * | 12/1945 | Johnston et al. | 277/341 |
| 2,449,514 | A * | 9/1948 | Scoville, Jr. | 277/341 |
| 3,221,818 | A | 12/1965 | Taylor et al. | 166/187 |
| 3,731,740 | A * | 5/1973 | Douglas | 166/120 |
| 5,875,852 | A | 3/1999 | Floyd et al. | 166/387 |
| 6,026,897 | A * | 2/2000 | Pringle et al. | 166/65.1 |
| 6,220,362 | B1 | 4/2001 | Roth et al. | 166/380 |
| 6,513,599 | B1 | 2/2003 | Bixenman et al. | 166/378 |
| 6,629,564 | B1 * | 10/2003 | Ramakrishnan et al. | 166/250.07 |
| 6,843,315 | B2 | 1/2005 | Coronado et al. | 166/166 |
| 6,848,510 | B2 * | 2/2005 | Bixenman et al. | 166/385 |
| 6,854,522 | B2 | 2/2005 | Brezinski et al. | 166/387 |
| 2002/0029886 | A1 * | 3/2002 | Pringle et al. | 166/313 |
| 2004/0035577 | A1 * | 2/2004 | Ramakrishnan et al. | 166/250.07 |
| 2004/0211560 | A1 * | 10/2004 | Richard et al. | 166/278 |
| 2005/0023004 | A1 | 2/2005 | King et al. | 166/387 |
| 2005/0045329 | A1 * | 3/2005 | Wetzel et al. | 166/278 |
| 2005/0257928 | A1 * | 11/2005 | Arizmendi et al. | 166/120 |
| 2005/0263287 | A1 * | 12/2005 | Achee et al. | 166/313 |

FOREIGN PATENT DOCUMENTS

WO WO 2006/036271 A1 4/2006

* cited by examiner

*Primary Examiner*—Hoang Dang
(74) *Attorney, Agent, or Firm*—Shawn Hunter

(57) ABSTRACT

Devices and methods for monitoring wellbore conditions while conducting hydrocarbon production within a wellbore, particularly an open-hole wellbore, having multiple zones within. A production tubing string assembly is made up having a plurality of packers for sealing within an open-hole wellbore having multiple individual zones. The production tubing string includes production nipples and one or more fiber optic sensor lines disposed upon the outside of the production tubing string. The sensor line or lines are disposed through the packers using a pass-through system so as to provide unbroken sensing line(s) to the surface of the wellbore. This allows temperature, pressure or other wellbore conditions to be monitored at the surface in each of the individual zones of interest.

19 Claims, 8 Drawing Sheets

OPTICAL SENSOR USE IN ALTERNATE PATH GRAVEL PACKING WITH INTEGRAL ZONAL ISOLATION

This application is a continuation-in-part to U.S. patent application Ser. No. 11/180,150 filed Jul. 13, 2005 now abandoned.

BACKGROUND OF THE INVENTION

1. Field of the Invention

The invention relates generally to systems and methods for production from open-hole wellbores having multiple zones within. In more particular aspects, the invention relates to production systems that are useful for gravel packing and isolating separate zones within an open-hole wellbore and which allow monitoring of wellbore conditions within the separate zones.

2. Description of the Related Art

Hydrocarbon production wellbores often extend through a number of separate zones within the earth. These zones are separated by layers of relatively impermeable rock. The individual zones may contain oil, gas, water, or a mixture of these fluids. It is desirable to isolate the individual zones within the wellbore to prevent movement of fluids between the zones within the wellbore, which could lead to contamination of the fluids being produced. This isolation is accomplished by creating a blockage within the wellbore between the production tubing string and the walls of the wellbore. Typically, the blockage is created by setting a packer within the wellbore.

Many current wellbore production systems have "open-hole" wellbores, wherein a portion of the wellbore is not lined with casing. Open-hole systems are prone to collapse along their uncased portions. Sand screens and gravel-packing are used to try to prevent this, as well as prevent sand production. For isolation of zones within an open-hole system, a packer assembly is needed that can provide large radial expansion of the sealing element. Unfortunately, conventional large expansion packer systems generally lack the ability to pass electrical or fiber optic cables or fluid conduits axially through the packer assembly so that other devices may be used below the packer device. The desirable requirements for a large diameter packer system are typically at odds with those for a conduit pass-through system. U.S. Pat. No. 6,220,362, issued to Roth et al. describes a pass-through conduit arrangement for a packer assembly or other tool. The Roth patent is owned by the assignee of the present invention and is incorporated herein by reference. Roth describes a system wherein one or more axial conduit passages are formed through an interior portion of a packer or other tool. Roth teaches that there be complete pressure isolation between the conduit and both the tubing and the annulus. However, Roth describes the use of a separate carrier 60 that lies radially within the tool mandrel 24 and is used to define the longitudinal passages for the conduits or cables. The potential exists for improper sealing between the carrier and mandrel during fabrication of the tool, leading to undesirable fluid entry into the longitudinal passages. Additionally, this design does not offer any means for radial communication of fluid outwardly from the flowbore of the tool to the radial exterior of the tool. In fact, the requirement that the longitudinal passages remain isolated from fluid pressure from the flowbore, as well as the annulus, dictates against penetration of the carrier and/or mandrel by a radial fluid communication passage. If the carrier and mandrel of this tool were perforated to allow radial fluid communication, the passages defined therebetween would undesirably become exposed to external wellbore fluid pressures.

To the inventor's knowledge, conduit feed through systems have not been successfully integrated into hydrostatically-set packer assemblies. It is believed that this failure is due to the complexity of a hydrostatic setting mechanism and the need for such a device to communicate hydrostatic fluid pressure through the inner mandrel of the packer assembly and into a chamber within the exterior portion of the packer assembly. The use of multiple interior pieces, such as a separate carrier and mandrel, to define a longitudinal cable/conduit pass-through, and the attendant assembly requirements, also adds to the difficulty of incorporating a cable feed-through feature into a hydrostatically-set device.

U.S. Pat. No. 6,842,315 issued to Coronado et al., describes a hydrostatically-set packer device having a composite sealing element with large radial expansion capabilities for use in through tubing and open hole applications. This patent is owned by the assignee of the present invention and is, therefore, incorporated by reference. The device of the '315 patent provides no feed-through arrangement for cables or conduits to be passed longitudinally through the packer device.

A further problem with the use of conventional production assemblies in open-hole, multi-zonal wellbores is that it is difficult to monitor the temperature and pressure of the separate zones. Once conventional packers are set between individual zones, there is no communication through the annulus across the packers. Thus, temperature, pressure or other conditions within a particular zone cannot be monitored within the annulus. This makes controlled production from individual zones much more difficult.

U.S. Pat. No. 6,854,522, issued to Brezinski et al. describes a system for setting a series of expandable isolators (packers) within an open-hole wellbore between individual zones. However, this system lacks any means for monitoring temperature, pressure or other conditions within the individual zones. In addition, the system lacks any means for communication of power or data across the isolators within the annulus.

The present invention addresses the problems of the prior art.

SUMMARY OF THE INVENTION

The invention provides devices and methods for monitoring wellbore conditions while conducting hydrocarbon production within a wellbore, particularly an open-hole wellbore, having multiple zones within. In a currently preferred embodiment, a production tubing string assembly is made up having a plurality of packers suitable for sealing within an open-hole wellbore having multiple individual zones. The packers are preferably set using hydraulic fluid pressure present within the flowbore of the production tubing string. In addition to the packers, the production tubing string includes production nipples having perforated screens for removal of debris from produced fluids. One or more fiber optic sensor lines are disposed upon the outside of the screens and running portion of the production tubing string. Alternatively, hydraulic control lines are disposed upon the outside of the screen to facilitate post-deployment fiber optic installation. The sensor line or lines are disposed through the packers using a pass-through system so as to provide unbroken sensing line(s) to the surface of the wellbore. This allows temperature, pressure or other wellbore conditions to be monitored at the surface in each of the individual zones of interest.

In operation, the production tubing string is lowered into the open-hole wellbore to a position wherein each of the production sections is disposed adjacent a production zone from which it is desired to produce fluids. Gravel packing is conducted, and the packer assemblies are then set to establish fluid seals within the annulus between separate individual zones. In currently preferred embodiments, the packers are set using the hydrostatic pressure within the flowbore of the production tubing string assembly. After the packer assemblies are set, production may be obtained from the various zones within the wellbore. In addition, temperature, pressure, or other wellbore conditions may be monitored at the surface via the sensor line.

BRIEF DESCRIPTION OF THE DRAWINGS

FIG. 2A is a side, cross-sectional view of a portion of the production tubing string assembly shown in FIG. 1, during initial run-in.

DETAILED DESCRIPTION OF THE PREFERRED EMBODIMENTS

Figure 1:
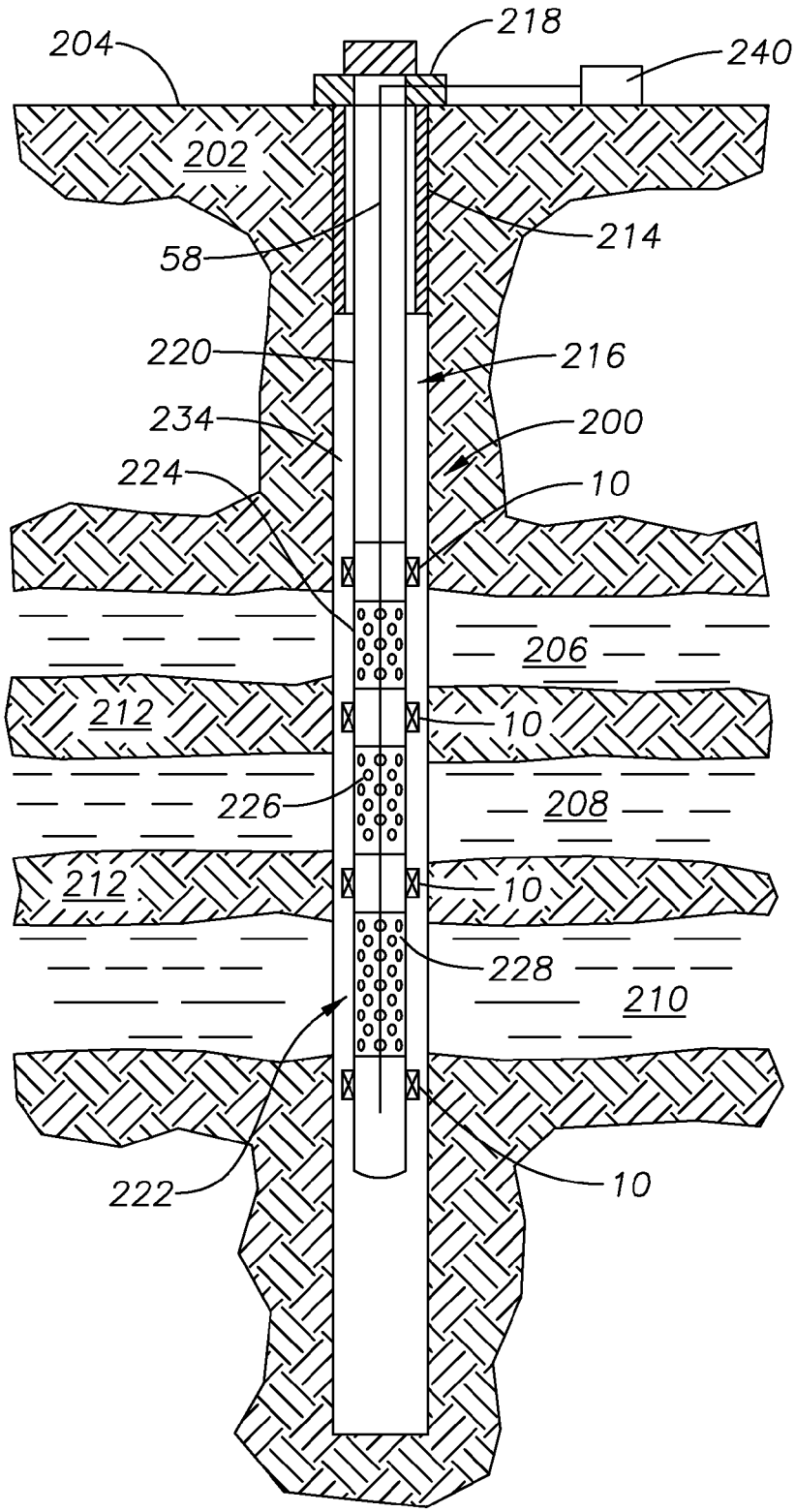
FIG. 1 is a side, cross-sectional view of an open-hole wellbore having a production tubing string assembly disposed therein that is constructed in accordance with the present invention.

FIG. 1 illustrates an exemplary open-hole wellbore 200 that has been drilled through the earth 202 from the surface 204. Although the wellbore 200 is depicted as being substantially vertically-disposed along its length, those of skill in the art will understand that portions of the wellbore 200 may be deviated or even horizontally-disposed. The wellbore 200 extends through a number of individual fluid-bearing zones 206, 208, 210 that are separated from one another by substantially impervious layers 212 of rock. In this example, each of the zones 206, 208, 210 contain oil or gas to be produced. A section of casing 214 is cemented into place near the surface 204 of the wellbore 200. However, those portions below the casing section 214 are open-hole portions that are not lined with casing.

Production tubing string assembly 216 is shown disposed within the wellbore 200 and suspended from a tubing hanger 218 at the surface 204. It is noted that fluid valving and other surface-control operations are not described in any detail herein as they are well understood by those of skill in the art. The production tubing string assembly 216 includes an upper running portion 220 and a lower production portion, generally indicated at 222. In the illustrated embodiment, the production portion 222 includes four packer assemblies 10, which axially isolate three production nipples 224, 226, and 228. Although only three productions nipples and four packer assemblies are shown in FIG. 1, those of skill in the art will understand that there may be more or fewer nipples and packer assemblies depending upon the number of zones from which it is desired to produce fluid. In FIG. 1, the tubing string assembly 216 has been lowered into the wellbore 200 until the production nipples 224, 226, 228 are located adjacent the zones 206, 208, 210, respectively, from which fluid is to be produced. In FIG. 1, the packer assemblies 10 have not yet been actuated to their set positions.

Figure 2A:
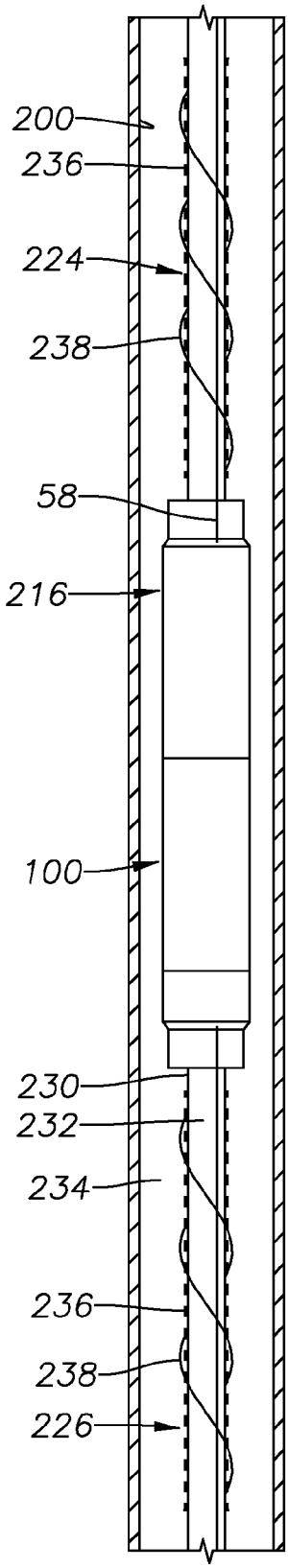
Figure 2B:
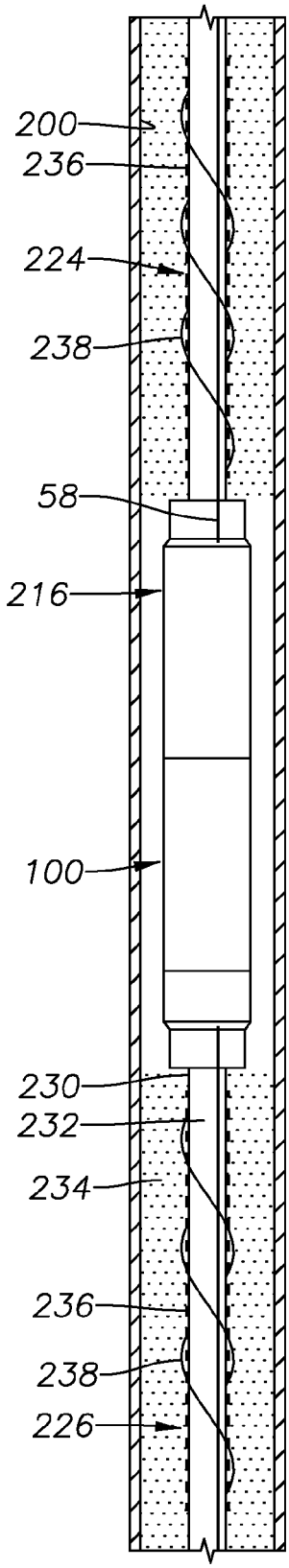
FIG. 2B is a side, cross-sectional view of the string assembly portion shown in FIG. 2A, now with gravel packing having been performed.
Figure 2C:
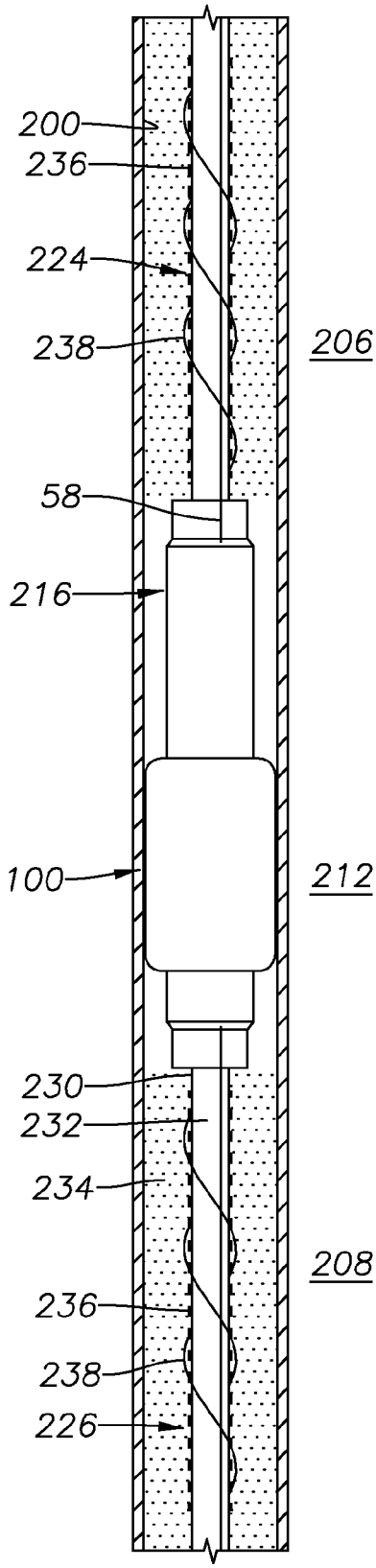
FIG. 2C is a side, cross-sectional view of the string assembly portion shown in FIGS. 2A and 2B, now with the packer assemblies having been set.
Figure 3A:
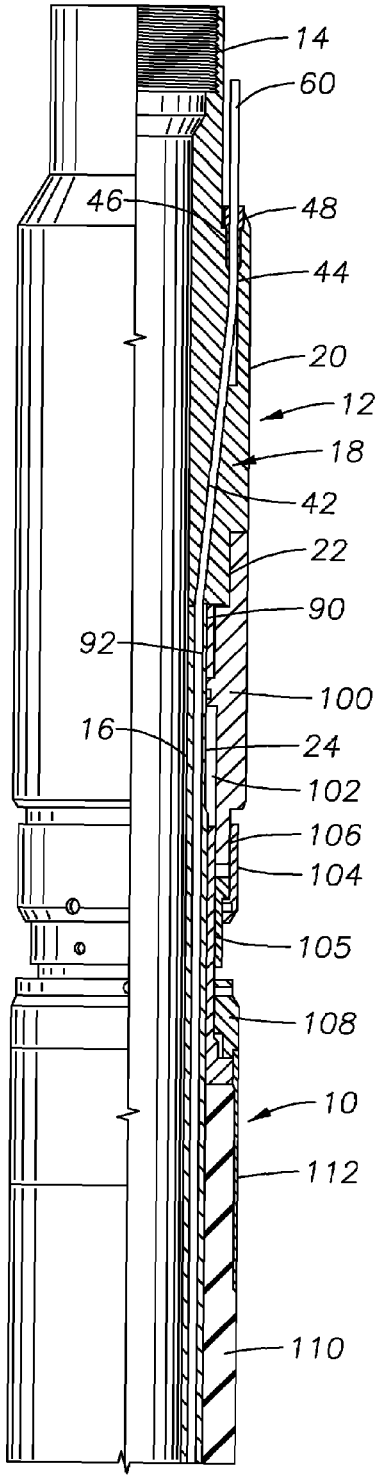
FIGS. 3A-3C present a side, cross-sectional view of an exemplary packer assembly with conduit feed through system constructed in accordance with the present invention.
Figure 3B:
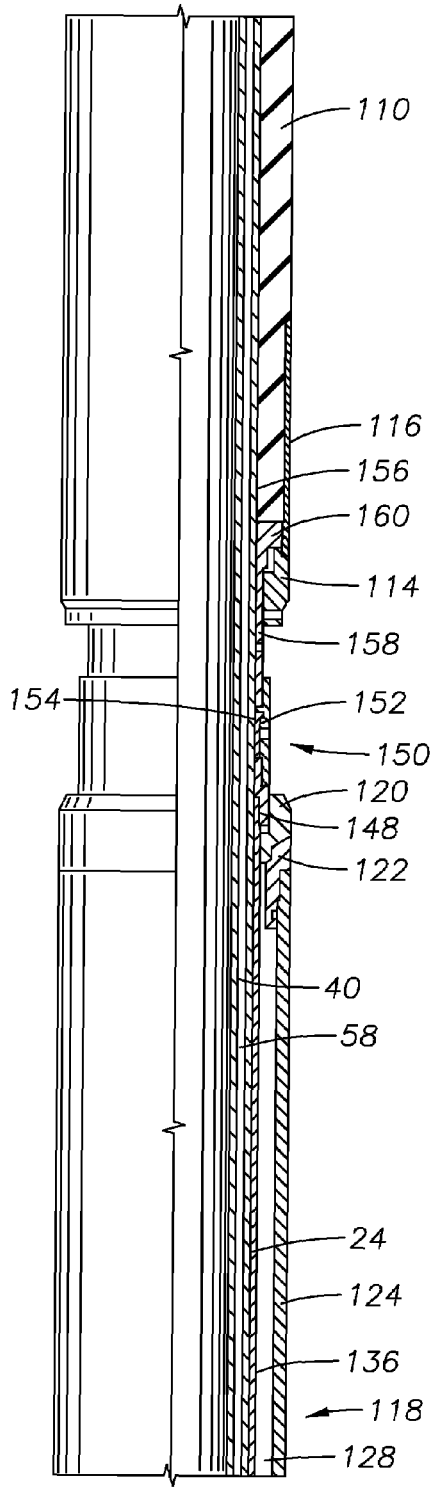
Figure 3C:
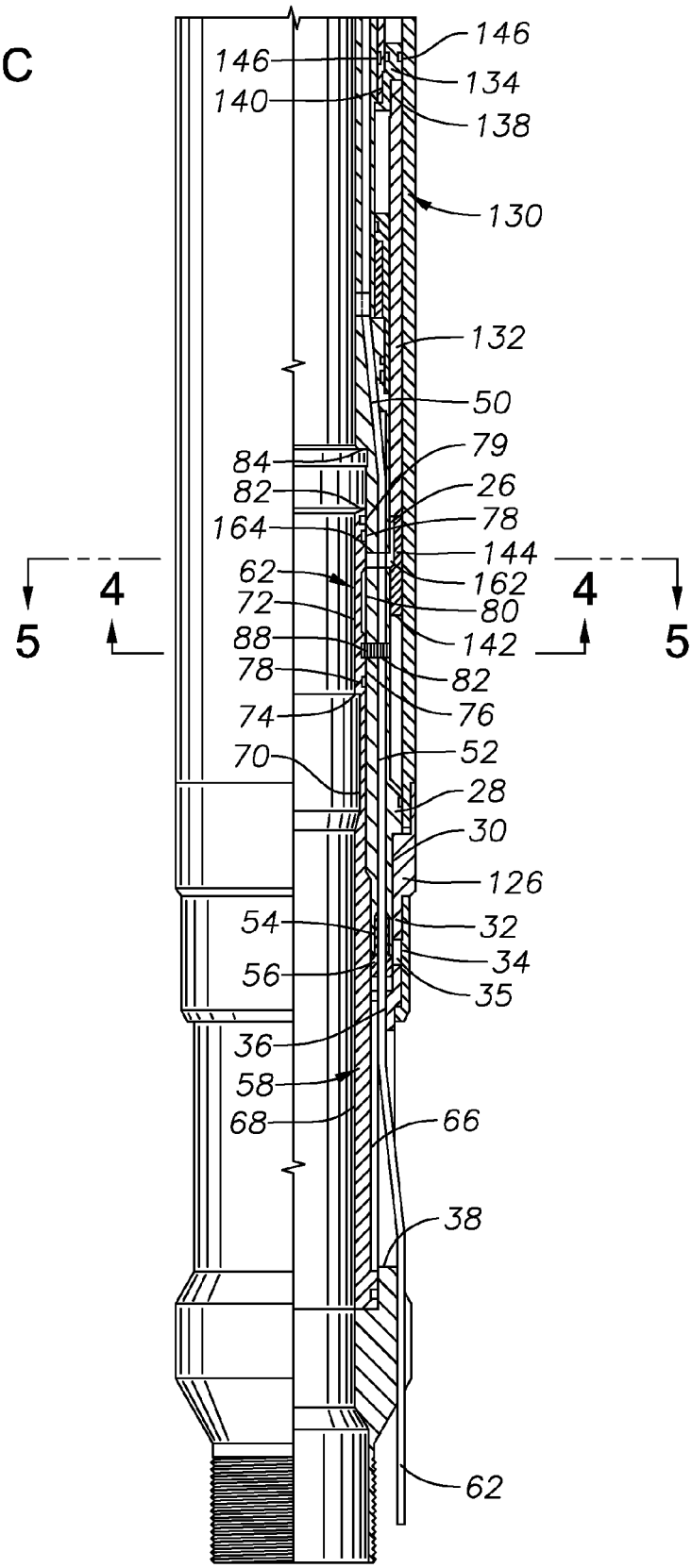
Figure 4:
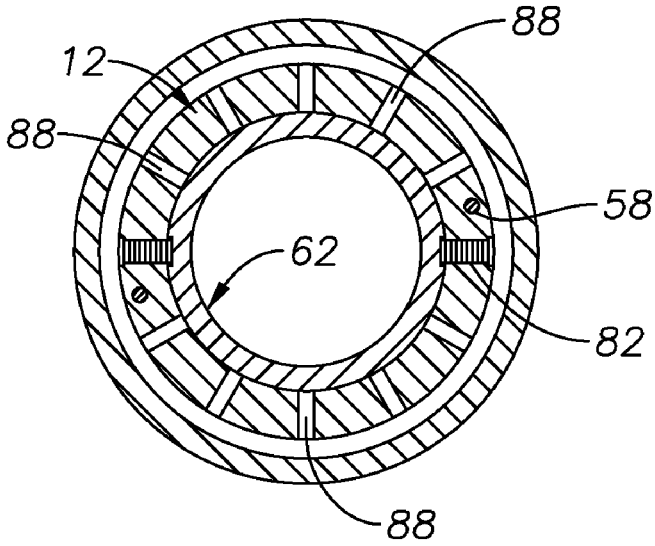
FIG. 4 is an axial cross-section taken along lines 4-4 in FIG. 3C.
Figure 5:
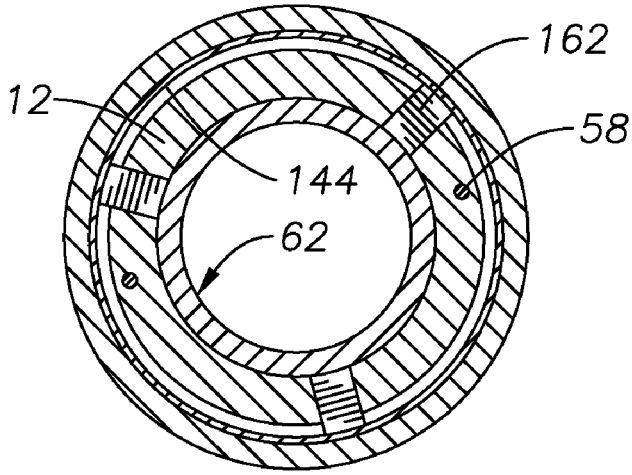
FIG. 5 is an axial cross-section taken along lines 5-5 in FIG. 1C.

FIGS. 2A-2C illustrate a packer assembly 100 and portions of adjacent production nipples 224, 226 in greater detail. The construction and operation of production nipple 228 will be identical to that of nipples 224 and 226. Each of the production nipples 224, 226 includes a tubular housing 230 that defines an axial flowbore 232 along its length. The axial ends of the tubular housing 230 are secured by threaded connection to the adjacent packer assembly 100, as is known in the art. The housing 230 is perforated, as is known, so that production fluid present within the annulus 234 can enter the flowbore 232 and thereby be transported to the surface 204 under the impetus of surface pumps.

Screens 236 radially surround the housing 230 to help remove debris and impurities from fluid entering the flowbore 232. Shunt tubes 238 are helically disposed around the screen. The shunt tubes 238 are known devices used for gravel packing. If an obstruction to the gravel packing slurry is encountered, as is not uncommon in open-hole wellbores, the shunt tubes help to direct gravel packing slurry past the obstruction by providing an alternate path for the slurry.

A fiber optic sensing cable 58 is disposed along the radial exterior of the production tubing string assembly 216 from a monitoring apparatus 240 (see FIG. 1) located at the surface 204. The fiber optic sensing cable 58 is used to monitor wellbore temperatures and pressures. Collectively, the monitoring apparatus 240 and the sensing cable 58 form a wellbore condition sensor assembly. It is noted that there may be more than one sensing cable 58 that is interconnected with the monitoring apparatus 240 in order to provide monitoring of multiple conditions within the annulus of the wellbore 200.

During operation, light is beamed down the fiber optic cable, or cables, 58. The light is reflected back to provide information about the pressures and temperatures at different points along the cable(s) 58, corresponding to different depths within the wellbore. Fiber optic sensing systems of this type are known in the art and commercially available from Baker Hughes Incorporated of Houston, Tex. As FIGS. 2A-2C depict, the fiber optic sensing cable 58 is located upon the radial exterior of the screens 236, but extends radially into and is passed axially through the packer assemblies 100. The details of a currently preferred pass-through arrangement will be described in detail shortly.

Installation of the production tubing string assembly 216 into the wellbore 200 is illustrated in FIGS. 2A, 2B, and 2C. In FIG. 2A, the assembly 216 has been lowered into the wellbore 200 to its desired location. Gravel packing is then conducted using standard well-known techniques. FIG. 2B illustrates the presence of deposited gravel 242 within the annulus 234 adjacent the two production zones 206, 208 from which it is desired to produce fluid. Next, the packers 100 are set, as illustrated in FIG. 2C to create fluid sealing within the annulus 234 between neighboring zones 206, 208, and 210. Due to the construction of the production tubing string assembly 216, the fiber optic sensing cable 58 is capable of monitoring temperature, pressure or other wellbore conditions along the entire length of the cable 58. This is a tremendous advantage over prior art systems, which either had no mechanism for zonal condition monitoring, or were incapable of it due to the seals created by the packers being set within the annulus.

FIGS. 3A-3C, 4, and 5 illustrate in detail one of the hydrostatically-set packer assemblies 10 that is constructed in accordance with the present invention. The packer assembly 10 includes a central mandrel 12 having an upper threaded end 14 which allows the packer assembly 10 to be incorporated into a production tubing string. The central mandrel 12 defines a central axial flowbore 16 along its length. A cable feed through path, generally designated as 18, passes through the central mandrel 12. Beginning at the upper end of the packer assembly 10, the central mandrel 12 features a radially enlarged upper portion 20 with outer threads 22. Below the enlarged upper portion 20 is a radially reduced mandrel portion 24. At the lower end of the radially reduced portion 24 is a lower radially enlarged portion 26. The enlarged portion 26 also defines an enlarged bore portion 27 within. The lower portion 26 presents an outwardly projecting shoulder 28 and a threaded connection 30 to a lower end sub 32. The lower end sub 32 includes a set of interfitting longitudinal anti-rotation splines 34 and an axial cable passage 36. The splines 34 engage complimentary splines 35 formed on the outside of the central mandrel 12. Below the cable passage 36 is a lateral cable opening 38.

In a currently preferred embodiment, the feed-though path 18 includes an axially-oriented longitudinal central portion 40 and an upper angled end portion 42 that extends from the upper end of the central portion 40 radially outwardly to an axial upper end passage 44. The axial upper end passage 44 includes an enlarged bore 46 that is shaped and sized to accommodate end nut 48. The lower end of the central portion 40 interconnects to a lower angled end portion 50 that extends radially outwardly to an axially-oriented lower portion 52. The lower end of the lower portion 52 also has an enlarged bore 54 that is shaped and sized to accommodate an end nut 56. It is noted that the feed-through path 18, and all of its individual components 40, 42, 50, 52, are preferably constructed by drilling of suitably sized holes or passages through the central mandrel 12. The component portions 40, 42, 50, 52 should interconnect with one another axially to provide a continuous path. An exemplary cable 58 is shown disposed within the feed-through path 18 and secured therewithin by end nuts 48, 56. It can be seen that a portion 60 of the fiber optic sensor cable 58 extends upwardly toward the entry of the wellbore (not shown) while another portion 62 of the cable 58 extends downwardly toward a location below the packer assembly 10. Thus, the cable feed-through path 18 allows communication through the packer assembly 10 to a device (not shown) that is located below the packer assembly 10. It is noted that the term "cable," is used herein to refer to an electrical cable, a hydraulic fluid conduit, a fiber optic cable, or any other type of tubular structure that is used to transmit fluid, power or communications into or out of a wellbore.

Figure 7:
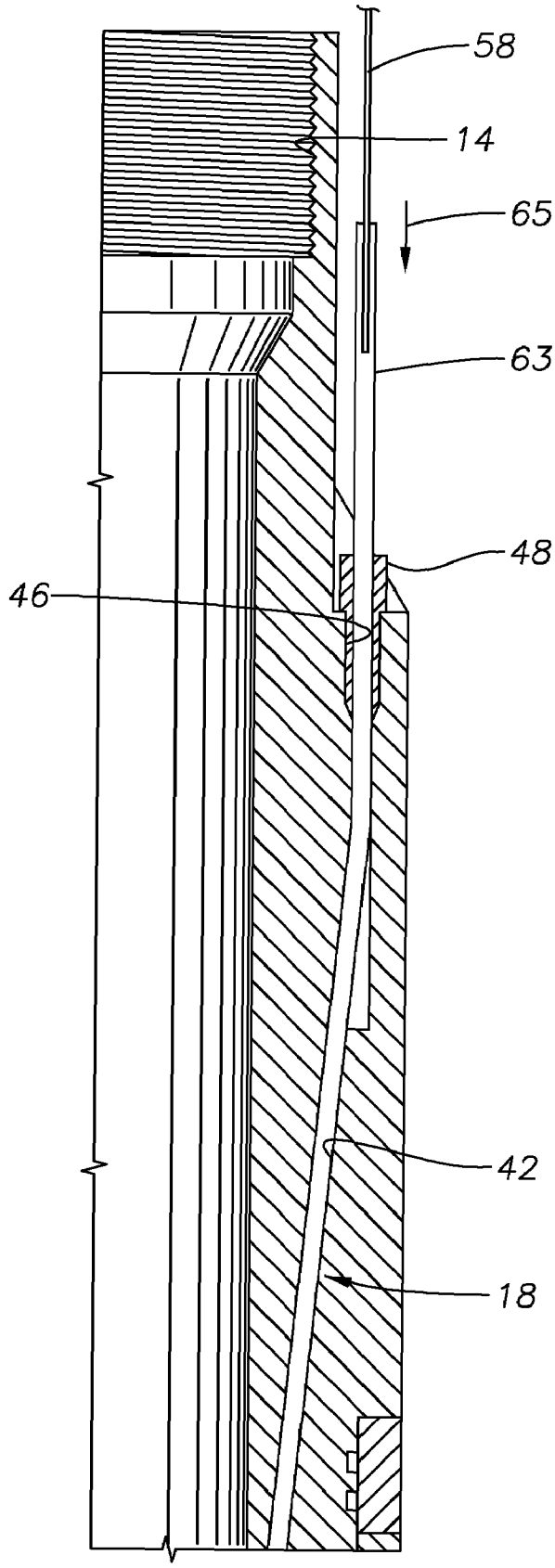
FIG. 7 Illustrates an alternative method of disposing a sensor cable along the exterior of a production tubing string assembly.

The sensing cable or cables 58 may be disposed along the production tubing string assembly 216 using one of two methods. First, the sensor cable or cables 58 may simply be disposed along the feed through path 18 and thereby affixed to the radial outer surface of the assembly 216 before it is run into the wellbore 200. An alternative method of disposing a cable 58 along the production tubing string assembly 216 is illustrated in FIG. 7. In this technique, a hollow hydraulic line 63 is disposed along the feed-through path 18 prior to the production tubing string assembly 216 being lowered into the wellbore 200. After run-in, the sensor cable 58 is disposed downwardly (in the direction of arrow 65) through the center of the hollow hydraulic line 63 until the sensor cable 58 extends along the entire length of the feed-through path 18. The cable 58 may be disposed through the line 63 by hydraulic injection or pumping from the surface.

The enlarged bore portion 27 of the central mandrel 12 accommodates an actuating sleeve 62 and an internal guide sleeve 64. The guide sleeve 64 provides a radially exterior surface 66 that defines the inner boundary of the lateral cable opening 38. Additionally, the guide sleeve 64 presents an inner surface 68 with an upper radially enlarged bore portion 70. The actuating sleeve 62 presents an inner surface 72 that extends radially inwardly of the enlarged bore 70, thereby creating an engagement shoulder 74 at the lower end of the sleeve 62. The outer radial surface 76 of the actuating sleeve 62 carries a number of annular fluid seals 78, a dog recess 80 and a locking ring 79. It is noted that the actuating sleeve 62 is axially moveable between a lower position, shown in FIG. 1, wherein the lower end of the sleeve 62 contacts the guide sleeve 64, and an upper position, shown in FIG. 2, wherein the upper end 82 of the actuating sleeve 62 contacts an internal stop shoulder 84 of the central mandrel 12. Frangible shear screws 82 pass through the body of the central mandrel 12 and into the actuating sleeve 62 to initially secure the actuating sleeve 62 in its lower position.

A plurality of radial fluid communication ports 88 also pass through the central mandrel 12 to provide fluid communication between the internal flowbore 16 of the mandrel 12 and its radial exterior. As FIG. 2 illustrates, the shear screws 82 are angularly offset from each of the fluid ports 88 about the circumference of the central mandrel 12. Fluid flow through the fluid ports 88 is initially blocked by the presence of the actuating sleeve 62 and fluid seals 78.

Beginning once again proximate the upper end of the packer assembly 10, a second set of longitudinal anti-rotation splines 90 are defined upon the central mandrel body 12. Splines 90 interfit with complimentary anti-rotation splines 92 on the central mandrel 12. The interfitting of the splines 90, 92 prevents rotation of the central mandrel 12 components with respect to one another.

The ring 98 is retained in place upon the outer surface of the central mandrel 12 by a housing sub 100 that is secured to the central mandrel 12 by threaded connection 22. An annular space 102 is defined between the lower end of the housing sub 100 and the outer surface of the central mandrel 12. Ring 104 is secured to the lower end of the housing sub 100 at threaded connection 106. The ring 104 provides tensioning portions 105, of a type known in the art, for exerting a tensioning force upon the packer element 110.

An upper end setting sleeve 108 also surrounds the central mandrel 12 below the ring 104. The setting sleeve 108 is used to help set the packer element 110 that lies immediately below it on the radial exterior of the central mandrel 12. During setting of the packer assembly 10, the upper end setting sleeve 108 remains stationary with respect to the central mandrel 12. The upper end setting sleeve 108 has a retainer portion 112 that extends over a portion of the packer element 110. A lower end setting sleeve 114 is located at the lower end of the packer element 110 and also presents a retainer portion 116 that extends over a portion of the packer element 110.

The packer element 110 is preferably a composite packer element as described in U.S. Pat. No. 6,843,315, issued to Coronado et al. This patent is owned by the assignee of the present invention and is herein incorporated by reference. This type of packer element is suitable for use in creating a fluid seal in larger bores and even uncased borehole sections. Below the lower end setting sleeve 114 is a setting, or actuating, assembly, generally shown at 118, having an upper sub 120 with fluid fill port 122, a setting assembly housing 124 and a lower sub 126. The setting assembly housing 124 encases an atmospheric chamber 128. The atmospheric chamber 128 is bounded at axial ends by the upper and lower subs 120, 126. When the piston assembly 10 is in the unset position (shown in FIG. 1), the atmospheric chamber 128 is at atmospheric pressure.

An actuating piston, generally shown at 130, is retained within the atmospheric chamber 128. The actuating piston 130 is made up of a lower piston ring 132, central ring 134, and an upper piston ring 136, these components being affixed to one another by threaded connections 138, 140. The lower piston ring 132 presents a fluid pressure receiving area 142. Additionally, the lower piston ring 132 has an annular dog recess 144 inscribed upon its inner surface. Elastomeric O-ring seals 146 are used to provide fluid sealing between the actuating piston 130 and the chamber 128. The upper end of the upper piston ring 136 is secured by threaded connection 148 to a body lock ring assembly 150. The body lock ring assembly 150 includes a locking ring 152 with an inner ratchet surface 154. The ratchet surface 154 is formed to interengage with outwardly-facing ratchet surface 156 on central mandrel 12. Packer element setting member 158 is affixed to the body lock ring assembly 150 and presents an enlarged setting portion 160 that abuts the lower end of the packer element 110.

A locking dog 162 initially secures the actuating piston 130 and the central mandrel 12 together. In the unset position, shown in FIG. 1, the dog 162 resides within a dog passage 164 that is disposed radially through the central mandrel 12. A portion of the dog 162 extends outwardly into dog recess 144 in the actuating piston 130. Movement of the dog 162 radially inwardly is blocked by the presence of actuating sleeve 62. It is noted that the dog 162 and all shear screws 82 are radially offset from the cable feed-through path(s) 18 so that the feed-through path(s) 18 remain unexposed to fluid ingress and wellbore pressures. This arrangement is best shown in FIGS. 2 and 3.

Figure 6A:
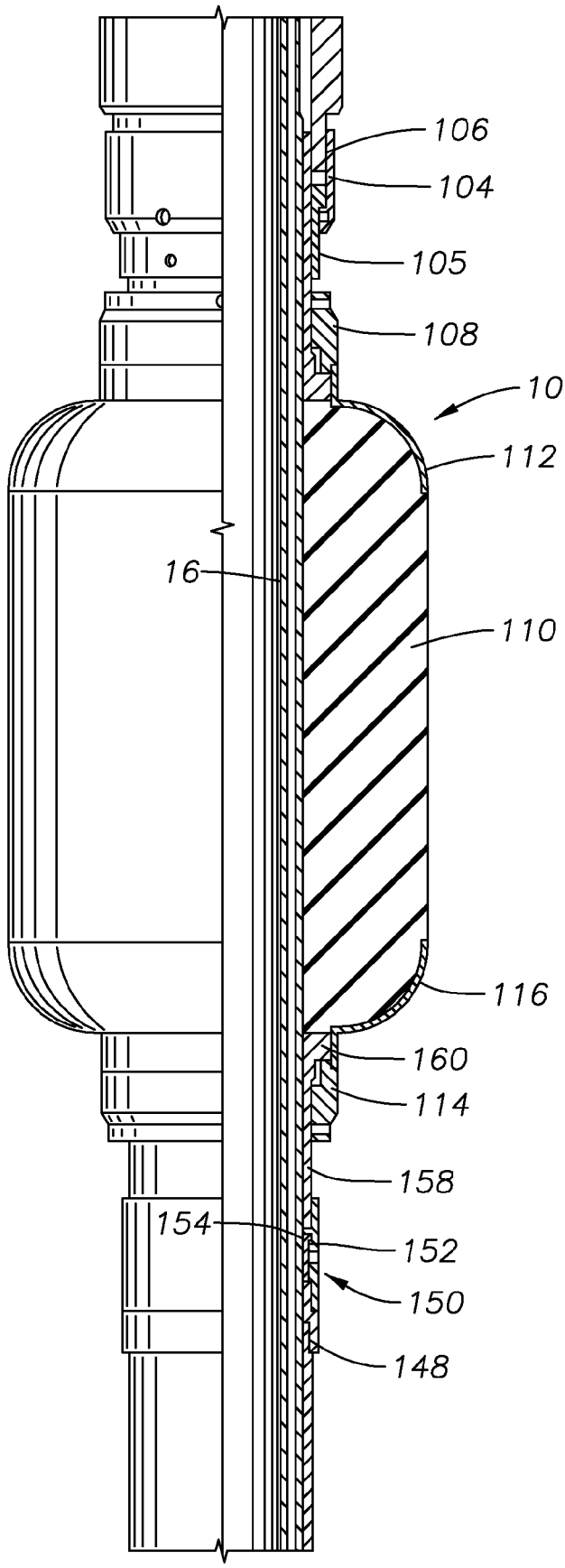
FIGS. 6A-6C present a side, cross-sectional view of the packer assembly shown in FIGS. 3A-3C, now with the packer element having been set.
Figure 6B:
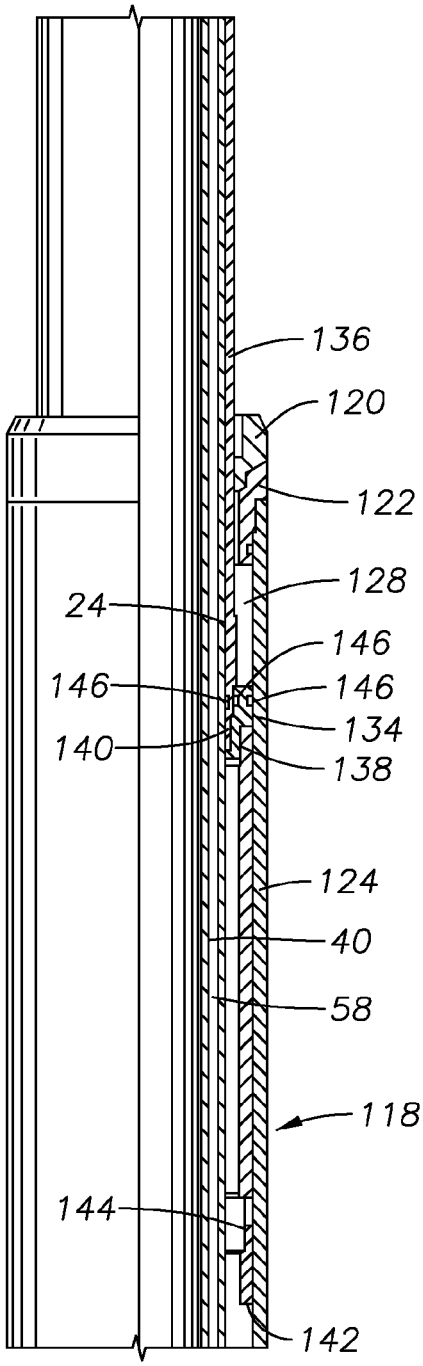
Figure 6C:
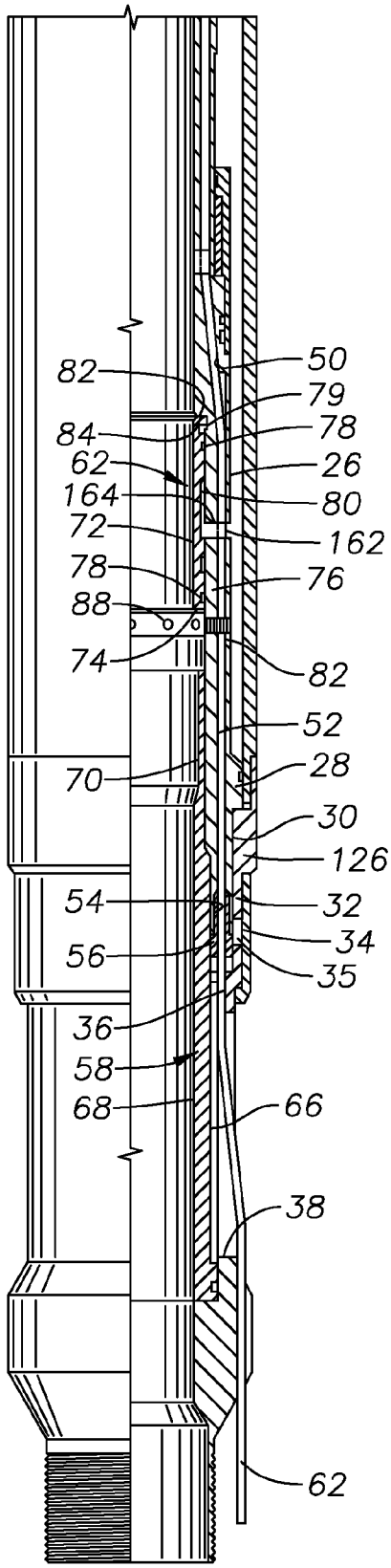

Hydrostatic forces are used to set the packer device 10. FIGS. 6A-6C show the packer device 10 in a set condition. When it is desired to set the packer assembly 10, a shifting tool (not shown), of a type known in the art, is disposed into the flowbore 16 of the central mandrel 12. The shifting tool contacts the engagement shoulder 74 of the actuating sleeve 62 and moves the actuating sleeve 62 axially upwardly. This movement will shear the shear screws 82 and unblock fluid communication ports 88. The locking ring 79 secures into a mating recess in the central mandrel 12 (see FIG. 6C) to secure the actuating sleeve 62 in the upward position. Additionally, upward movement of the actuating sleeve 62 will bring the dog recess 80 into general alignment with the locking dog 162. The dog 162 is moved radially inwardly to reside partially within the recess 80 and is thus moved out of the outer dog recess 144. This unlocks the actuating piston 130 from engagement with the central mandrel 12. As upward movement of the actuating sleeve 62 unblocks the fluid ports 88, hydrostatic fluid pressure present within the flowbore 16 will then be transmitted through the ports 88 and enter the pressure receiving area 142. Wellbore hydrostatic pressure will bear upon the pressure receiving area 142 of the actuation piston 130 and urge the piston 130 axially upwardly. The packer element setting member 158 will compress the packer element 110 axially to cause it to expand radially and become set.

It can be seen that the packer assemblies 10 each provide a means for disposing one or more linear sensing cables 58 axially through a hydrostatically-set packer device while also permitting radial fluid communication through the central mandrel. The feed-through paths 18 of the packer assembly 10 desirably isolate the cables from fluid pressure present in either the flowbore 16 or the annulus surrounding the packer device 10. Because the feed-through paths 18 are angularly offset from the fluid communication ports 88 about the circumference of the central mandrel 12, fluid pressure being communicated radially through the mandrel 12 will not enter the feed-through paths 18.

Cables 58 extending through the feed-through paths 18 are also protected from axial tensional forces that would be exerted upon the packer assembly 10 as it is being used as well as torsional forces that might be experienced as the packer assembly 10 is being made up or run in the well. The cables are retained in place within the feed-through path(s) 18 by end nuts 48, 56, which secure them to the central mandrel 12.

It can be seen that the systems and methods of the present invention permit completion of a production assembly by gravel packing and setting of the packer assemblies 10. Advantageously, the systems and methods of the present invention allow for temperature, pressure, or other wellbore conditions to be monitored by the monitoring assembly 240 during this entire process and during subsequent production.

Those of skill in the art will recognize that numerous modifications and changes may be made to the exemplary designs and embodiments described herein and that the invention is limited only by the claims that follow and any equivalents thereof.

What is claimed is:

1. A production string assembly for producing hydrocarbon fluid from a wellbore comprising:

a production nipple for placement proximate a production zone within the wellbore;

a packer assembly for selectively forming a fluid seal within an annulus of the wellbore, the packer assembly having:

a) a central tubular mandrel defining a flowbore to contain hydrostatic pressure;

b) a packer element carried by the central mandrel, the packer element being moveable between an unset position and an axially compressed set position;

c) a setting mechanism radially surrounding the central mandrel for moving the packer element to its set position in response to hydrostatic pressure within the flowbore;

a wellbore condition sensor assembly having a monitor device and a linear sensor cable disposed generally upon the radial exterior of the production nipple and being disposed axially through the packer assembly; and a feed-through path defined axially through the mandrel, the feed-through path retaining the sensor cable in isolation from external fluid pressures.

2. The production string assembly of claim 1 wherein the packer assembly comprises a hydrostatically-set packer device.

3. The production string assembly of claim 1 wherein the packer assembly includes a hydrostatic setting assembly that comprises:

a mandrel defining a central axial flowbore;

a radial fluid communication port disposed through the mandrel; and an actuating sleeve that lies within the central flowbore and is moveable between a first position, wherein fluid communication through the radial fluid communication port is blocked, and a second position, wherein the actuating sleeve does not block the port.

4. The production string assembly of claim 1 wherein the packer assembly comprises a composite packer element for use in creating a fluid seal within an uncased borehole.

5. The production string assembly of claim 1 wherein the feed-through path comprises a longitudinal drilled hole in the central mandrel.

6. The production string assembly of claim 1 wherein the production nipple comprises:

a tubular housing having openings to allow fluid communication between the wellbore and a flowbore defined within the housing; and a screen radially surrounding the housing to help remove debris from fluid entering the flowbore within the housing.

7. The production string assembly of claim 6 wherein the production nipple further comprises a gravel packing shunt tube helically surrounding the screen.

8. A production string assembly for producing hydrocarbon fluid from a wellbore comprising:

a running portion;

a production portion secured to the running portion and having:

a plurality of production nipples in secured relation within the production portion for placement proximate a plurality of production zones within the wellbore, the production nipples having openings for drawing of production fluid inwardly from the surrounding wellbore;

a plurality of packer assemblies for selectively forming a fluid seal within an annulus of the wellbore, the packer assemblies being incorporated within the running portion to isolate the production nipples from one another, at least one packer assembly having:

a) a central tubular mandrel defining a flowbore to contain hydrostatic pressure;

b) a packer element carried by the central mandrel, the packer element being moveable between an unset position and an axially compressed set position;

c) a setting mechanism radially surrounding the central mandrel for moving the packer element to its set position in response to hydrostatic pressure within the flowbore;

a wellbore condition sensor assembly having a monitor device and a linear sensor cable disposed generally upon the radial exterior of the production nipples and being disposed axially through at least one of the packer assemblies; and a feed-through path defined axially through at least one central mandrel of the at least one packer assembly, the feed-through oath retaining the sensor cable in isolation from external fluid pressures.

9. The production string assembly of claim 8 wherein the packer assemblies are hydrostatically-set packer devices.

10. The production string assembly of claim 8 wherein the packer assemblies each include a composite packer element for use in creating a fluid seal.

11. The production string assembly of claim 8 wherein the production nipples each include a radially-surrounding screen for removal of debris from fluid entering the nipple.

12. The production string assembly of claim 8 wherein the production nipples each include a helical shunt tube for use in gravel packing.

13. The production string assembly of claim 8 wherein the wellbore condition sensor assembly is capable of monitoring temperature within the wellbore.

14. The production string assembly of claim 8 wherein the wellbore condition sensor assembly is capable of monitoring pressure within the wellbore.

15. A method of producing hydrocarbon fluids from a wellbore having multiple production zones therein while monitoring a wellbore condition of said wellbore, the method comprising the steps of:

a) disposing a production string assembly into the wellbore, the production string assembly defining an axial flowbore therewithin and having:

a production nipple for each production zone to be produced, the production nipple being perforated to allow entry of production fluid from a production zone into the flowbore;

at least one packer assembly for isolating each production nipple from a neighboring production nipple, the at least one packer assembly having:

a central tubular mandrel defining a flowbore to contain hydrostatic pressure;

a packer element carried by the central mandrel, the packer element being moveable between an unset position and an axially compressed set position;

a setting mechanism radially surrounding the central mandrel for moving the packet element to its set position in response to hydrostatic pressure within the flowbore;

a wellbore condition sensor assembly having a monitor device and a linear sensor cable disposed generally upon the radial exterior of the production string assembly, the sensor cable further being disposed axially through the central mandrel of the at least one packer assembly;

b) gravel packing within the wellbore around the production nipples;

c) setting the packer assemblies; and d) using the wellbore condition sensor assembly to monitor at least one wellbore condition proximate each production zone to be produced.

16. The method of claim 15 wherein the step of selling the packer assemblies comprises causing fluid within the flowbore under hydrostatic pressure to urge a setting sleeve toward a set position to axially compress a packer element of each packer assembly.

17. The method of claim 15 wherein the wellbore condition being monitored is temperature.

18. The method of claim 15 wherein the wellbore condition being monitored is pressure.

19. The method of claim 15 wherein the linear sensor cable is disposed generally upon the radial exterior of the production string assembly by disposing the sensor cable through a hydraulic line secured to the production string assembly.

* * * * *

UNITED STATES PATENT AND TRADEMARK OFFICE

CERTIFICATE OF CORRECTION

PATENT NO. : 7,441,605 B2
APPLICATION NO. : 11/273191
DATED : October 28, 2008
INVENTOR(S) : Coronado et al.

It is certified that error appears in the above-identified patent and that said Letters Patent is hereby corrected as shown below:

Column 9, line 50, the word “oath” should be changed to --path--.

Column 10, line 45, the word “selling” should be changed to --setting--.

Signed and Sealed this

Tenth Day of February, 2009

JOHN DOLL
*Acting Director of the United States Patent and Trademark Office*